US006011429A

United States Patent [19]

Oda

[11] Patent Number: 6,011,429

[45] Date of Patent: Jan. 4, 2000

[54] REFERENCE VOLTAGE GENERATING DEVICE

[75] Inventor: Toshiaki Oda, Tokyo, Japan

[73] Assignee: NEC Corporation, Tokyo, Japan

[21] Appl. No.: 09/016,456

[22] Filed: Jan. 30, 1998

[30] Foreign Application Priority Data

Jan. 31, 1997 [JP] Japan ..... 9-031477

[51] Int. Cl.[7] ..... G05F 3/02

[52] U.S. Cl. ..... 327/546; 327/545

[58] Field of Search ..... 327/540, 541, 327/545, 546

[56] References Cited

U.S. PATENT DOCUMENTS

| | | | |
|---|---|---|---|
| 4,929,947 | 5/1990 | Toyama | 341/146 |
| 5,337,284 | 8/1994 | Cordoba et al. | 365/227 |
| 5,347,170 | 9/1994 | Hayakawa et al. | 327/541 |
| 5,400,294 | 3/1995 | Srinivasan et al. | 365/230.06 |
| 5,530,397 | 6/1996 | Nakai et tal. | 327/545 |
| 5,565,811 | 10/1996 | Park et al. | 327/546 |
| 5,708,387 | 1/1998 | Cleveland et al. | 327/536 |
| 5,825,237 | 10/1998 | Ogawa | 327/545 |
| 5,856,756 | 1/1999 | Sasahara et al. | 327/540 |

FOREIGN PATENT DOCUMENTS 4-252312 9/1992 Japan .

*Primary Examiner*—Terry D. Cunningham
*Attorney, Agent, or Firm*—Scully, Scott, Murphy & Presser

[57] ABSTRACT

In a reference voltage generating device, it causes rising of output of reference voltage to speed while preventing wrap-around of power source noise after rising of reference voltage. It causes an electric supply circuit to connect to a reference voltage output terminal of a reference voltage generating source, while switching ON switches only prescribed period from just after power-ON-timing by power control signal until the time when timer circuit operates. And then after lapse of prescribed time, when the timer circuit terminates its operation, the electric charge circuit is disconnected from the reference voltage output terminal due to OFF of the switches. Consequently, during prescribed time from power ON, charging current toward load capacitance attached to the reference voltage output terminal increases, thus reference voltage rises rapidly. After rising, since the electric charge supply circuit is disconnected from the reference voltage output terminal by the switches, it is not affected by wraparound-noise of the power source through the electric charge supply circuit.

10 Claims, 6 Drawing Sheets

POWER ON
SWITCH ON
TIMER ON
TIMER OFF
SPS
STM
VR
Vo
GROUN

REFERENCE VOLTAGE GENERATING DEVICE

BACKGROUND OF THE INVENTION

The present invention relates to a reference voltage generating device. More to particularly this invention relates to a reference voltage generating circuit which is controlled by a power control signal.

Description of the Prior Art

There is a reference voltage supply circuit for providing reference voltage for an external circuit. The Japanese Patent Application Laid-Open No. HEI 4-252312 discloses a reference voltage generating device in order that it causes rise time to expedite at the time of applying of reference voltage. FIG. 1 is a constitution view showing one example of a conventional reference voltage generating device. In FIG. 1, a resistor $R_1$ and a first capacitor Ci are always connected in a series in between a reference voltage output line A of a reference voltage generating source 1 and a power source $V_{DD}$. A second capacitor $C_2$ is always connected in between the reference voltage output line A and ground. Thereby, it causes a reference voltage output $V_0$ at rise time of the power source to rise rapidly to a voltage value which is settled from the ratio of combined impedance of the resistor $R_1$ and the first capacitor $C_1$ to an impedance of the second capacitor $C_2$, thus it causes the time to shorten when the reference voltage output $V_0$ rises until the reference voltage which is of the object. A low pass filter (LPF) is constituted by the resistor $R_1$ and the first and the second capacitors $C_1$, $C_2$, thus it causes high-frequency noise to remove. The high-frequency noise comes wraparound to the reference voltage output terminal A from the power source.

In the above reference voltage generating device, since the low pass filter (LPF) consisting of the resistor $R_1$, the first and the second capacitors $C_1$, $C_2$ are always connected in between the power source $V_{DD}$ and the reference voltage output terminal A after rising of the power source, in some circuit constants, noise of frequency which is incapable of being removed comes wraparound to the reference voltage output terminal A, power source noise after rising of reference voltage is not necessarily removed sufficiently.

Furthermore, since the load capacitance $C_L$ is connected in between the reference voltage output terminal and the ground, the capacitors $C_1$, $C_2$ are necessary to be sufficiently large value such that the load capacitance $C_L$ can be neglected. However, when value of the load capacitance $C_L$ becomes large, there is the problem that it is difficult to realize the capacitors $C_1$, $C_2$ on the integrated circuit.

SUMMARY OF THE INVENTION

In view of the foregoing, it is an object of the present invention for achieving above mentioned problem to provide a reference voltage generating device in which it causes rising of the reference voltage to speed while preventing wraparound of noise of the power source after rising of the reference voltage.

It is another object of the present invention to provide a reference voltage generating device in which if large load capacitance is attached to the reference voltage output terminal, it causes rising of the reference voltage to speed, without increasing circuit constant until impossible level for realizing on the integrated circuit.

In accordance with one aspect of the present invention, for achieving the above-mentioned objects, there is provided a reference voltage generating device comprising a reference voltage generating source for generating reference voltage causing power control signal to rise, an electric charge supply circuit for supplying electric charge to a reference voltage output terminal, and a timer circuit for counting count value during prescribed time to output timer output signal for operating switch, wherein the electric charge supply circuit is controlled by the switch of the timer circuit such that it causes output of the electric charge supply circuit to supply to the reference voltage output terminal of the reference voltage generating source during prescribed time from the time point when the reference voltage generating source is triggered.

Preferably, there is provided a reference voltage generating device wherein the electric charge supply circuit comprises a power source terminal, a resistance division circuit for dividing voltage of the power source terminal to be outputted, and a switch being controlled by the timer circuit in terms of ON/OFF state.

Preferably, there is provided a reference voltage generating device wherein the electric charge supply circuit comprises the resistance division circuit for dividing voltage of the power source terminal in which resistance division circuit is constituted such that a first resistor, a first switch, a second switch, and a second resistor are connected in series in between the power source terminal and ground, the first and second switches are controlled by the timer circuit in terms of ON/OFF state, and connection point of the first and second switches is connected to reference voltage output point of the reference voltage generating source.

Preferably there is provided a reference voltage generating device wherein the electric charge supply circuit comprises a power source terminal, and a switch which is connected in between the power source terminal and the reference voltage output terminal of the reference voltage generating source, and which is controlled by the timer circuit in terms of ON/OFF state.

Preferably, there is provided a reference voltage generating device wherein the switch is a P-channel MOS transistor.

As stated above, the reference voltage generating device according to the invention in which the switch comes to be ON-state during prescribed period when the timer operates from just after power-ON-timing due to the power control signal, with the result that the electric charge supply circuit consisting of power source, resistance division circuit and so forth is connected to the reference voltage output terminal. Further when operation of the timer is terminated after elapsing prescribed time, the switch comes to be OFF-state, thus the electric charge supply circuit is disconnected from the reference voltage output terminal. For this reason, the reference voltage rises rapidly while increasing charging current to the load capacitance which is connected to the reference voltage output terminal at the time power-ON. After rising, since the reference voltage output terminal is disconnected from the electric charge supply circuit such as the power source by the switch, it is capable of removing influence of noise from the power source scarcely. Further, the circuit constant of the electric charge supply circuit is enough that time constant including the load capacitance rises with sufficiently rapid time, thus it is not necessary to provide large-capacity of capacitor or the like which is difficult to realize on the integrated circuit.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

A preferred embodiment of the present invention will now be described in detail referring to the accompanying drawings.

Figure 1:
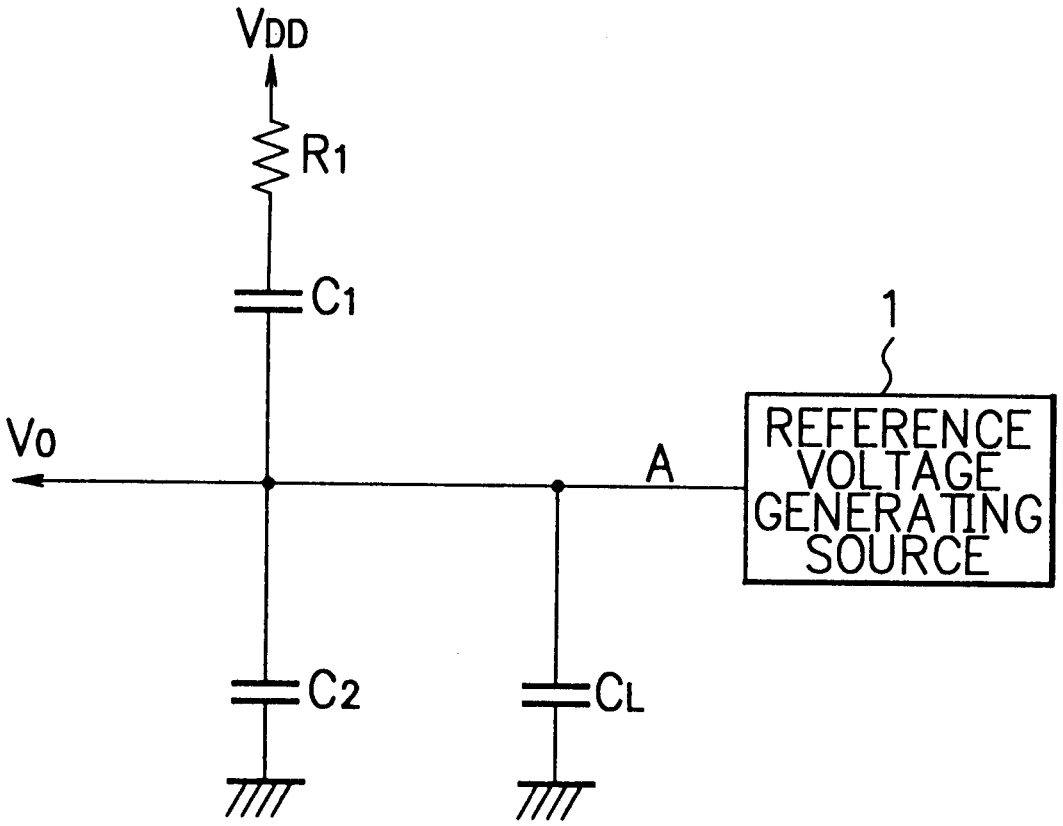
FIG. 1 PRIOR ART
FIG. 1 is a circuit view showing a conventional example of a reference voltage supply circuit.
Figure 2:
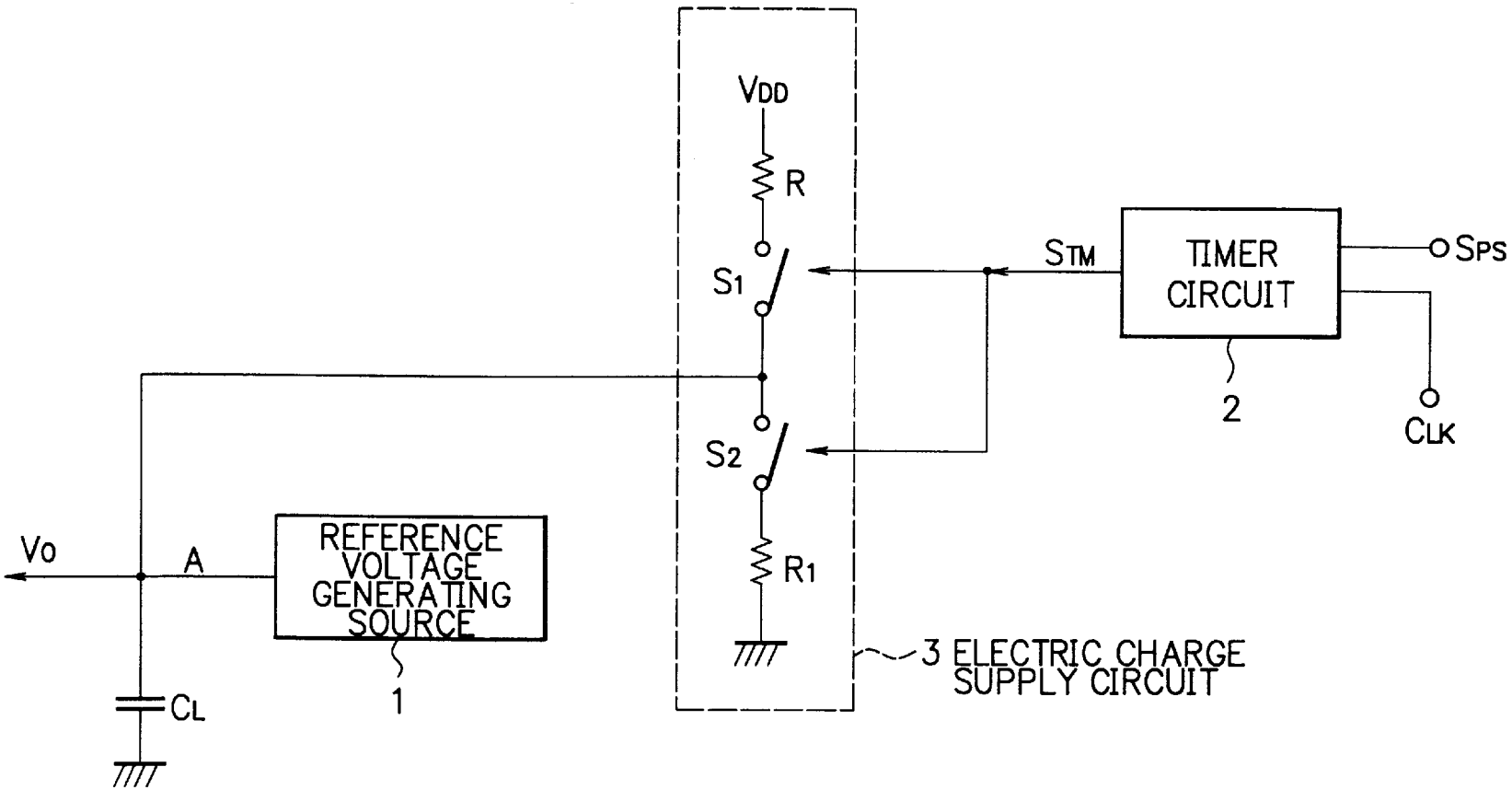
FIG. 2 is a circuit view showing a first embodiment of a reference voltage supply circuit according to the present invention.
Figure 3:
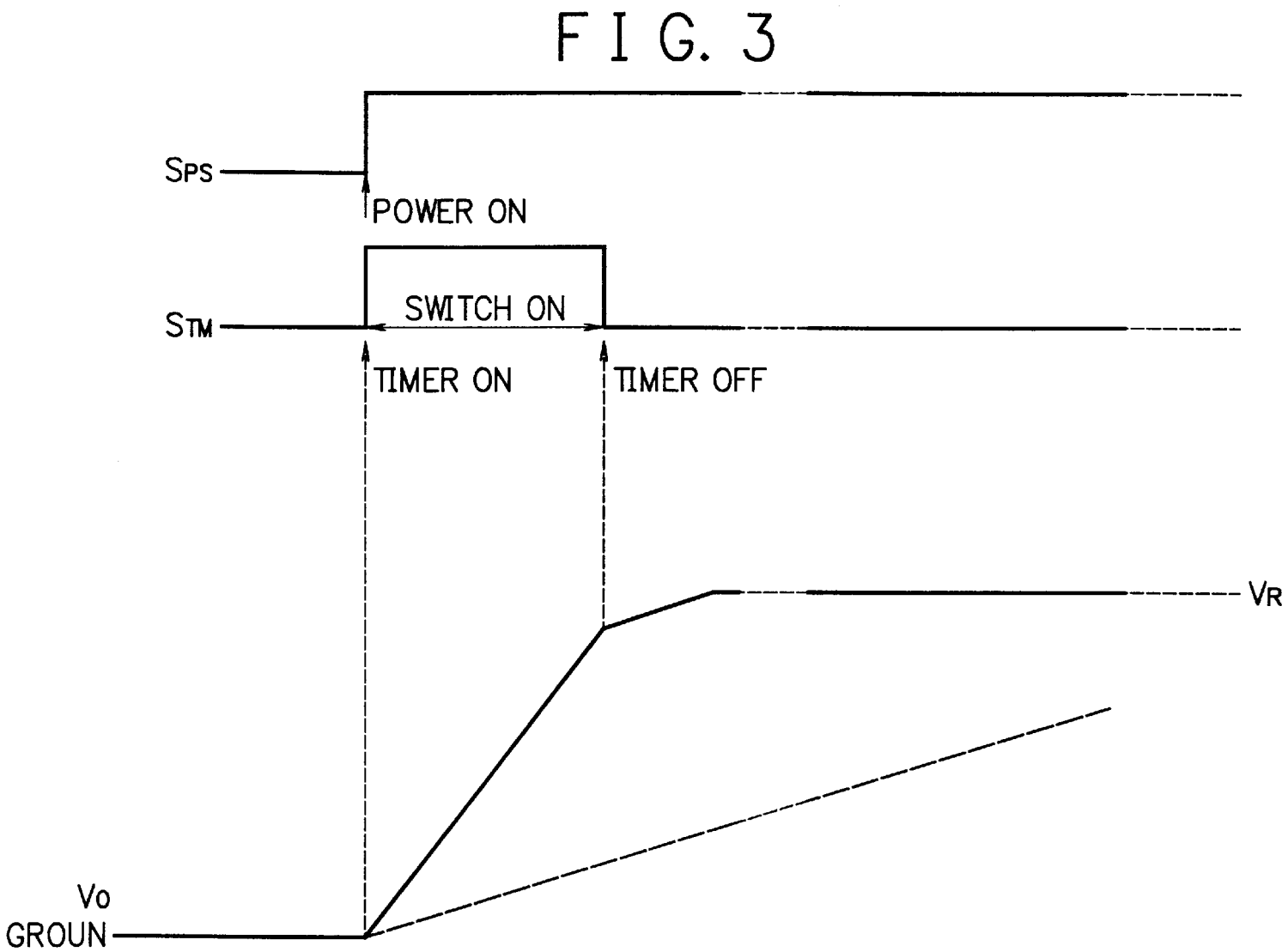
FIG. 3 is a time chart showing operation of FIG. 2.
Figure 6:
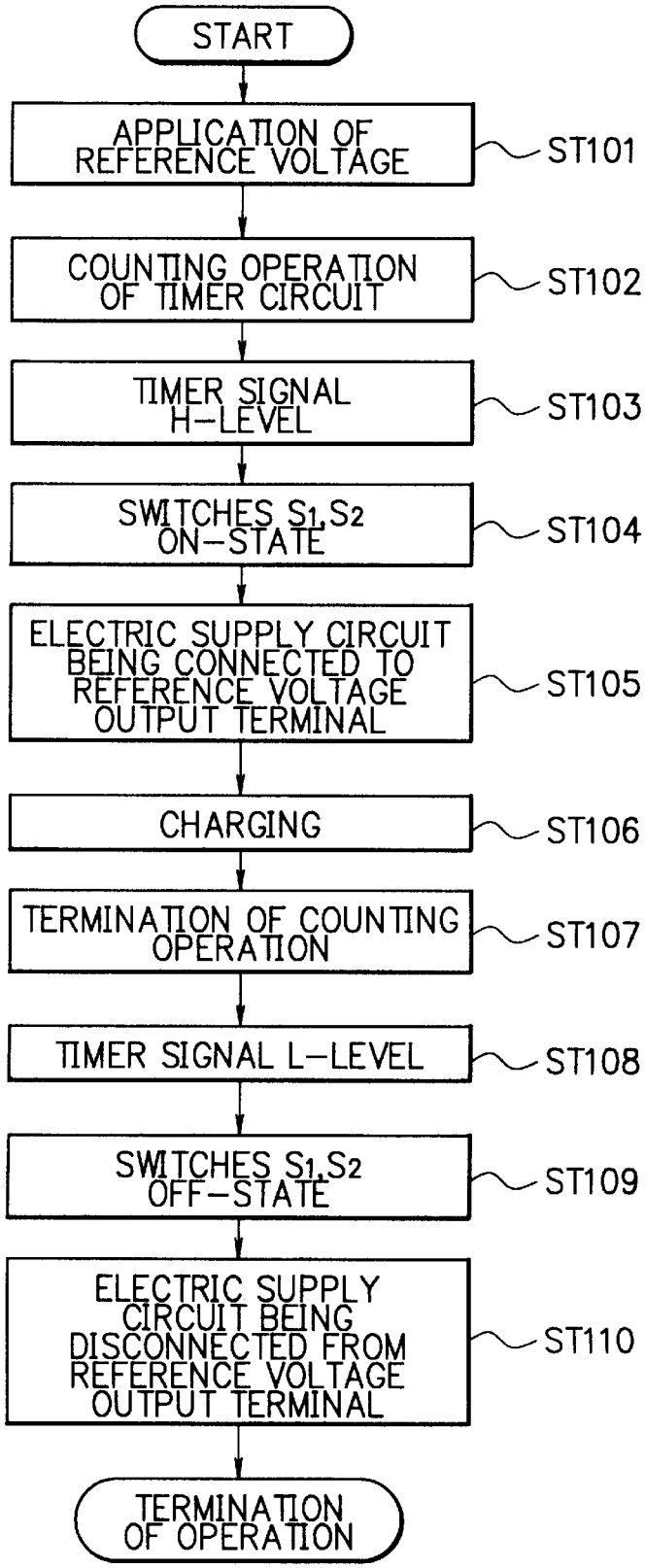
FIG. 6 is a flow chart showing operation of the first embodiment of a reference voltage supply circuit according to the present invention.

FIG. 2 is a circuit view showing a first embodiment of a reference voltage supply circuit according to the present invention. FIG. 3 is a time chart showing operation of FIG. 2. FIG. 6 is a flow chart showing operation of the first embodiment of a reference voltage supply circuit according to the present invention.

The first embodiment of the invention will be described referring to FIG. 2. In FIG. 2, a reference voltage generating source 1 outputs reference voltage $V_0$, thus supplying the reference voltage $V_0$ to an external circuit. At this time, load capacitance $C_L$ is added to a reference voltage output terminal A, which load capacitance $C_L$ is generated by influence of the external circuit or wiring or the like. A timer circuit 2 to which clock signal $C_{LK}$ and power control signal $S_{PS}$ are inputted, outputs timer output signal $S_{TM}$ which denotes ON/OFF state in answer to whether or not timer is of counting operation. The power control signal $S_{PS}$ is inputted to the timer circuit 2 in such a way that L-level thereof at the time of power-off is inputted and H-level thereof at the time of power-on is inputted thereto. The timer circuit 2 outputs L-level of the timer output signal $S_{TM}$ at the time of timer operation off (during timer stop), and outputs H-level of the timer output signal $S_{TM}$ at the time of timer operation on (in timer counting) . An electric charge supply circuit 3 has a constitution of resistance division circuit in which it causes resistors $R_1$, $R_2$ and switches $S_1$, $S_2$ to connect in series between power source VDD and ground. When H-level as the control signal is inputted to the switches $S_1$, $S_2$, the switches $S_1$, $S_2$ come to be ON-state (short), while when L-level as the control signal is inputted to the switches $S_1$, $S_2$, the switches $S_1$, $S_2$ come to be OFF-state (open). The switches $S_1$, $S_2$ to which the timer output signal $S_{TM}$ is inputted as a control signal, comes to be on state when the timer output signal $S_{TM}$ is of H-level and comes to be OFF- state when the timer output signal $S_{TM}$ is L-level. Output of the electric charge supply circuit 3 is derived from midpoint of the resistance division circuit, thus being provided for the reference voltage output terminal A connected to the midpoint.

Next, operation will be described referring to FIGS. 3 and 6. The power control signal comes to be L-level before the reference voltage is applied, so that whole circuit is of power off state. At the time when the count of the timer circuit 2 halts, the timer output signal $S_{TM}$ comes to be L-level. Consequently, the switches $S_1$, $S_2$ are of OFF-state, thus the electric charge supply circuit 3 is disconnected from the reference voltage output terminal A. Further, the reference voltage $V_0$ falls into ground level because the load capacitance $C_L$ is of discharged state.

When the reference voltage is applied from the reference voltage generating source 1 (ST 101), the power control signal $S_{PS}$ rises, and from the rising time point, counting operation of the timer circuit 2 starts (ST 102), thus the timer output signal $S_{TM}$ comes to be H-level (ST 103). Consequently, the switches $S_1$, $S_2$ come to be ON (ST 104), thus output of the electric supply circuit 3 is supplied to the reference voltage output terminal A (ST 105). Thereby, the load capacitance $C_L$ is charged rapidly by output in which output of the reference voltage generating source 1 is added to output of the electric supply circuit 3 (ST 106). When it causes value of resistance $R_1$, $R_2$ to be selected as:

$$V_R=R_2/(R_1+R_2)\cdot V_{DD}$$

such that divided voltage of the resistance division circuit comes to be desired value $V_R$ with desired value of the reference voltage as $V_R$, the reference voltage $V_0$ rises rapidly in the direction of $V_R$ as shown in the solid line of FIG. 3. The timer circuit 2 counts a count value corresponding to the time set beforehand which time is a time when the reference voltage $V_0$ comes close to the desired value $V_R$ sufficiently. Then, the count of the timer circuit 2 halts (ST 107), thus the timer output signal $S_{TM}$ comes to be L-level (ST 108). The switches $S_1$, $S_2$ come to be OFF (ST 109), so that the electric supply circuit 3 (resistance division circuit) is disconnected from the reference voltage output terminal A (ST 110). As a result, electric supply source to the load capacitance $C_L$ becomes only the reference voltage generating source 1, however, since the reference voltage $V_0$ already arrives at the neighborhood of the desired value $V_R$, the reference voltage $V_0$ arrives at the desired value $V_R$ rapidly to be stabilized.

Consequently, total rise time comes to be sped in comparison with rise time in independent reference voltage generating source 1 shown in a dotted line of FIG. 3, because of boosting charge according to the electric supply circuit 3. Further, after the boosting charge, since the switches $S_1$, $S_2$ interrupts current path of the electric charge supply circuit 3, it is not necessary to consume operation current which is unnecessary after rising. Furthermore, after the boosting charge, since the power source $V_{DD}$ is disconnected from the reference voltage output terminal A by the switches $S_1$, $S_2$, influence of the noise of power source comes to be not much. In addition thereto, since the rise time is settled in accordance with time constant which is determined by the resistors $R_1$, $R_2$ and the load capacitance $C_L$, the rise time is capable of setting most suitably by adjusting the value of the resistors $R_1$, $R_2$.

Besides, in FIG. 2, the electric charge supply circuit 3 is constituted such that a resistor $R_1$, a switch $S_2$, and a resistor $R_2$ are connected in series one by one in between the power source $V_{DD}$ and the ground. However a resistor $R_1$, a resistor $R_2$, and a switch $S_2$ are capable of being connected in series one by one in between the power source $V_{DD}$ and the ground.

Figure 4:
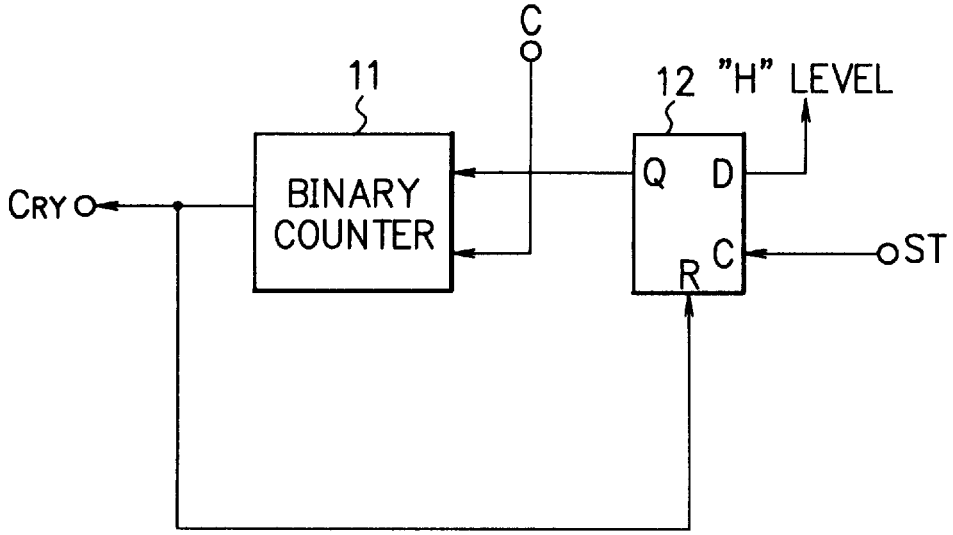
FIG. 4 is a circuit view showing a timer circuit employed in the present invention.

FIG. 4 shows one example of an available timer circuit in the present invention, which timer circuit comprises a binary counter 11 and a D-flip-flop 12. In FIG. 4, when it causes a start signal ST to be inputted to a C-terminal with a D-terminal of the D-flip-flop 12 as H-level state, H-level is outputted from a Q-terminal, thus it triggers the binary counter 11 to invert its output CRY. Count of clock signal applied to the C-terminal is started. When amount of the count comes into set count value, output of the binary counter 11 is inverted again. It causes the D-flip-flop 12 to reset due to its inversion output, thus terminating timer operation. Besides, as a timer circuit, it is not restricted to example of FIG. 4. It is capable of being used any one for example, monostable multivibrator capable of analog time setting is available.

Figure 5:
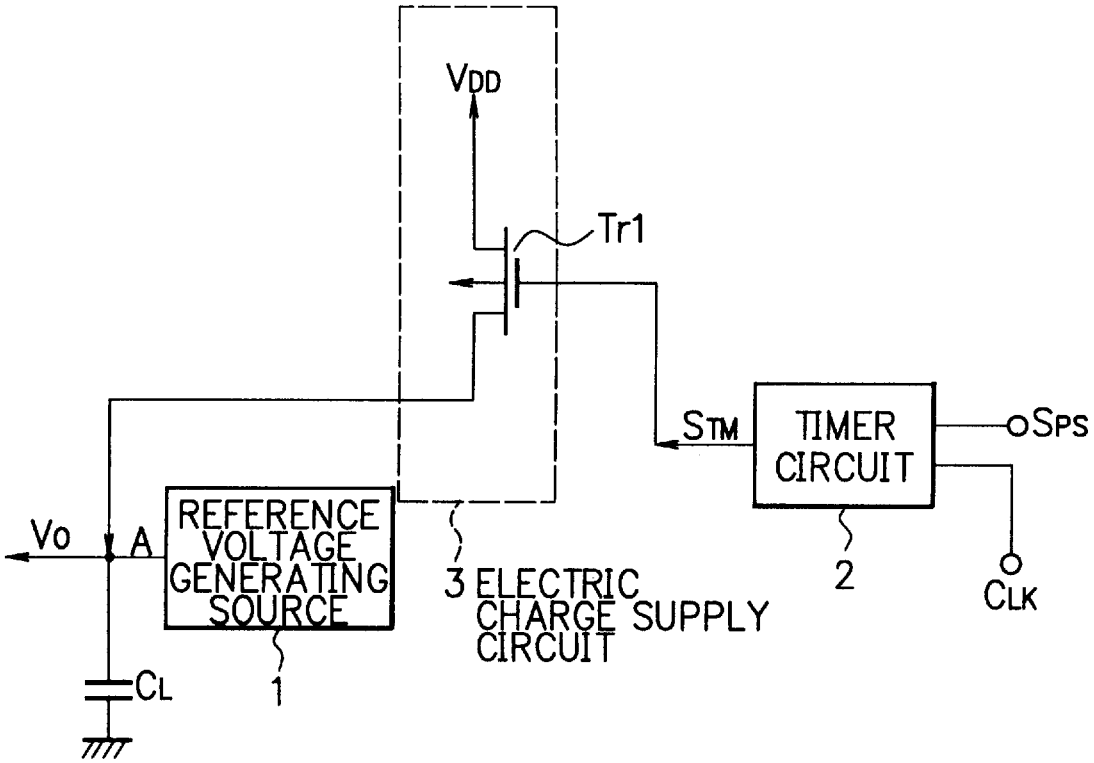
FIG. 5 is a circuit view showing a second embodiment of a reference voltage supply circuit according to the present invention.
Figure 7:
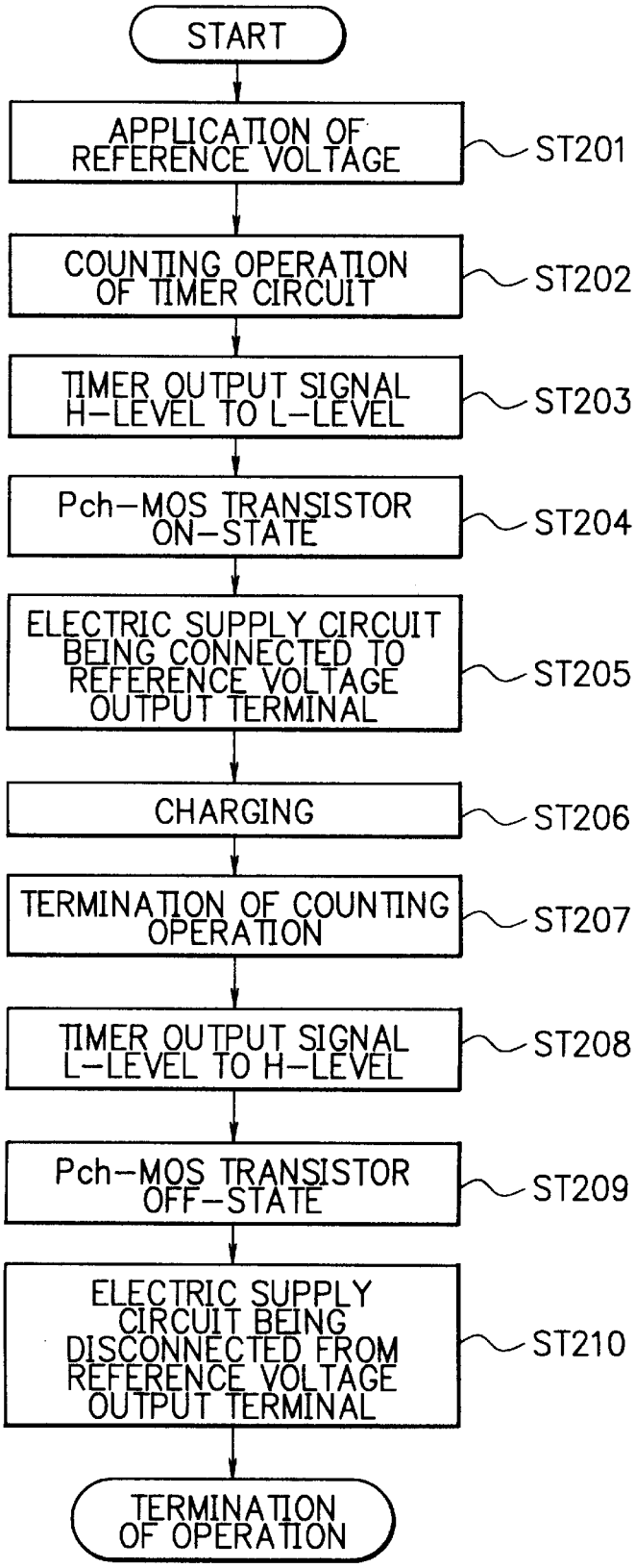
FIG. 7 is a flow chart showing the second embodiment of a reference voltage supply circuit according to the present invention.

FIG. 5 is a circuit view showing a second embodiment according to the present invention. FIG. 7 is a flow chart showing the second embodiment of the present invention.

Next, a second embodiment of the present invention will be explained referring to FIGS. 5 and 7. In the second embodiment, it causes the circuit constitution of the electric charge supply circuit 3 to change in the first embodiment in which it is constituted by only Pch-MOS transistor Tr1 such that a source terminal is connected to the power source $V_{DD}$, a drain terminal is connected to the reference voltage output terminal A, and a gate terminal is connected to the timer output terminal $S_{TM}$.

Operation of the second embodiment is the same as that of the first embodiment fundamentally exception for logic of the timer output terminal $S_{TM}$ which is inversely to the first embodiment. Before applying the reference voltage, the power control signal $S_{PS}$ comes to be L-level, the whole circuit is of power OFF. At this time, the timer circuit 2 halts. H-level is outputted from the timer output signal $S_{TM}$. The Pch-MOS transistor Tr1 is of OFF-state. The electric charge supply circuit 3 is disconnected from the reference voltage output terminal A. Further, since the reference voltage $V_0$ is of the discharged state of the load capacitance $C_L$, thus the reference voltage $V_0$ falls into ground level.

When the power control signal $S_{PS}$ rises with the reference voltage from the reference voltage generating source 1 applied (ST 201), the timer circuit 3 starts count operation (ST 202).

Since the timer output signal $S_{TM}$ is changed from H-level to L-level (ST 203), the Pch-MOS transistor Tr1 comes to be ON state (ST 204), thus the electric charge supply circuit 3 is connected to the reference voltage output terminal A (ST 205). Consequently, the load capacitance $C_L$ is charged rapidly toward the power source voltage $V_{DD}$ (=5.0 V) by the output obtained from addition output of the reference voltage generating source 1 to output of the electric charge supply circuit 3 (ST 206). The timer circuit 2 counts a count value corresponding to the time set beforehand which time is a time when the reference voltage $V_0$ comes close to the desired value $V_R$ (=2.5 V) sufficiently. Then, the count of the timer circuit 2 halts (ST 207), thus the timer output signal $S_{TM}$ comes to be changed from L-level to H-level (ST 208). The Pch-MOS transistor $Tr_1$ comes to be OFF-state (ST 209), thus the electric charge supply circuit 3 is disconnected from the reference voltage output terminal A (ST 210). As a result, electric supply source to the load capacitance $C_L$ becomes only the reference voltage generating source 1, however, since the reference voltage $V_0$ already arrives at the neighborhood of the desired value $V_R$ (=2.5 V), the reference voltage $V_0$ arrives at the desired value $V_R$ (=2.5 V) rapidly to be stabilized. In the second embodiment, when the electric charge supply circuit 3 is connected, since the reference voltage $V_0$ rises rapidly toward the power source voltage $V_{DD}$ (=5.0 V) instead of the object value $V_R$ (=2.5 V), it is capable of further speeding the rise time. If operation time of the timer 2 is set such that it causes the rising to stop at the time when the reference voltage $V_0$ arrives in the vicinity of the object value $V_R$ (=2.5 V), then the reference voltage of the object value $V_R$ (=2.5 V) can be obtained immediately.

As described above, according to the present invention, it causes the electric charge supply circuit to connect to the reference voltage output terminal through the switch in order to speed the rising only when the reference voltage rises, while after rising it causes the electric charge supply circuit to disconnect therefrom, thereby, it causes rising of the reference voltage to speed, and it is capable of preventing wraparound of power source noise from the electric charge supply circuit after rising. Further, after the boosting charge, since the switch interrupts current path of the electric charge supply circuit 3, it is not necessary to consume operation current which is unnecessary after rising.

Furthermore, it is proper that the circuit constants of the present invention is set to such that the reference voltage rises sufficiently short time by combining the load capacitance with resistance value, thereby even if the reference voltage output includes large load capacitance, it is capable of speeding rising of the reference voltage without increasing the circuit constants until impossible level on the integrated circuit.

While preferred embodiments of the invention have been described using specific terms, such description is for illustrative purpose only, and it is to be understood that changes and variations may be made without departing from the spirit or scope of the following claims.

What is claimed is:

1. A reference voltage generating device, comprising:

a reference voltage generating source for providing a reference voltage output signal at a source output terminal in response to a source activation signal;

an electric charge supply circuit connected to the output terminal for supplying electric charge during an active state of a timer output signal; and a logical timer circuit connected to the charge supply circuit for supplying said timer output signal;

wherein said timer output signal is set to an active state for a predetermined time period corresponding to a set count value of a counting initiated by said activation signal.

2. The reference voltage generating device as claimed in claim 1, wherein said electric charge supply circuit is also connected to a power source terminal and comprises a resistance division circuit for dividing a voltage of said power source terminal to be outputted to said charge supply circuit, and a switch being controlled by said logical timer circuit in terms of ON/OFF state.

3. The reference voltage generating device as claimed in claim 2, wherein said resistance division circuit is constituted such that a first resistance, a first switch, a second switch, and a second resistance are connected in series in between said power source terminal and ground, said first and second switches are controlled by said logical timer output signal to supply charge to said reference voltage generating source when said timer output signal is in its active state.

4. The reference voltage generating device as claimed in claim 1 wherein said electric charge supply circuit is also connected to a power source terminal and comprises a switch which is connected in between said power source terminal and said reference voltage output terminal of said reference voltage generating source, and which charge supply circuit is controlled by said logical timer circuit in terms of ON/OFF state.

5. A reference voltage generating device as claimed in claim 4, wherein said switch is a P-channel MOS transistor.

6. The method for charging a reference voltage generating device comprising the steps of:

generating a reference voltage at a reference voltage output terminal of a reference voltage generating source which causes a power control signal to rise during a presence of an active trigger signal at said source;

supplying an amount of electric charge to said reference voltage output terminal for a prescribed time; and counting a count value to define said prescribed time to output a timer output signal for operating a switch which controls said amount of electric charge supplied to said reference output terminal, said prescribed time extending from a time when the reference voltage generating source is triggered by said active trigger signal until that time that the counting reaches said predetermined count value.

7. A method for charging an output terminal of a reference voltage source of a reference voltage generating device to provide a stable reference voltage output signal, comprising the steps of:

providing the reference voltage output signal at the source output terminal in response to a presence of a source activation signal;

supplying a supplemental electric charge from a charge supply circuit to the source output terminal during an active state of a timer output signal;

counting a time during which said activation signal is present at said source and generating a count value corresponding to the counting time; and outputting said timer output signal in one of: (1) said active state when the count value is less than a predetermined count value, and (2) an inactive state when the count value is not less than the predetermined count value.

8. The method of claim 7, wherein said step of supplying includes the use of a switch which is responsive to the active and inactive states of said timer output signal.

9. The method of claim 8, wherein said step of supplying includes the use of a pch-MOS transistor as said switch.

10. The method of claim 7, wherein said step of providing includes providing said reference voltage output signal to a load capacitance.

* * * * *

UNITED STATES PATENT AND TRADEMARK OFFICE

CERTIFICATE OF CORRECTION

PATENT NO. : 6,011,429

DATED : January 4, 2000

INVENTOR(S) : Toshiaki Oda

It is certified that error appears in the above-identified patent and that said Letters Patent is hereby corrected as shown below:

On The Title Page, [56] References Cited, FOREIGN PATENT DOCUMENTS: Insert

| | | |
|---|---|---|
| --63-074035 | 4/1988 | Japan |
| 7-334124 | 12/1995 | Japan |
| 8-056128 | 7/1996 | Japan |
| 8-171081 | 7/1996 | Japan |
| 8-185144 | 7/1996 | Japan-- |

Column 5, Line 21 and 33: "Pch-MOS" should read --PMOS--

Column 5, Line 43 and 56: "Pch-MOS" should read --PMOS--

Column 6, Line 44, Claim 1: After "counting" insert --operation of said logic timer circuit--

Column 7, Line 10: After "said" insert --voltage generating--

Column 7, Line 10: "at" should read --to--

Column 7, Line 21: "that" should read --a later--

UNITED STATES PATENT AND TRADEMARK OFFICE

CERTIFICATE OF CORRECTION

PATENT NO. : 6,011,429

DATED : January 4, 2000

INVENTOR(S) : Toshiaki Oda

It is certified that error appears in the above-identified patent and that said Letters Patent is hereby corrected as shown below:

Column 8, Line 21, Claim 9: "Pch-Mos" should read --PMOS--

Signed and Sealed this

Twenty-third Day of January, 2001

*Attest:*

*Attesting Officer*

Q. TODD DICKINSON

*Commissioner of Patents and Trademarks*